United States Patent [19]

Cerny

[11] Patent Number: 4,740,036

[45] Date of Patent: Apr. 26, 1988

[54] SPLITTING APPARATUS AND METHOD

[76] Inventor: Alexander Cerny, P.O. Box 417, Sechelt, British Columbia, Canada, V0N 3A0

[21] Appl. No.: 42,983

[22] Filed: Apr. 27, 1987

[51] Int. Cl.[4] ..... E21C 37/16

[52] U.S. Cl. ..... 299/14; 299/20; 125/23 R

[58] Field of Search ..... 299/14, 20; 125/1, 23 R

[56] References Cited

U.S. PATENT DOCUMENTS 1,719,257 7/1929 Booth et al. ..... 299/14

FOREIGN PATENT DOCUMENTS 1284385 12/1968 Fed. Rep. of Germany ..... 299/14

1284574 11/1962 France ..... 299/14

126845 11/1960 U.S.S.R. ..... 299/14

310811 10/1971 U.S.S.R. ..... 299/14

1048115 10/1983 U.S.S.R. ..... 299/20

*Primary Examiner*—Stephen J. Novosad

*Assistant Examiner*—David J. Bagnell

*Attorney, Agent, or Firm*—Fetherstonhaugh & Co.

[57] ABSTRACT

Apparatus to split a body in which the apparatus is received. The apparatus has a first metal component of a first coefficient of expansion and a second metal component of a second coefficient of expansion, different from the first. The second body is attached to the first body. Whereby heating the apparatus causes a marked distortion in the apparatus to exert force on a body in which it is received, sufficient to split the body.

6 Claims, 1 Drawing Sheet

SPLITTING APPARATUS AND METHOD

FIELD OF THE INVENTION

This invention relates to an apparatus to split a body. The invention finds particular application in splitting of stone and also relates to a method of splitting a body preferably a stone body.

DESCRIPTION OF THE PRIOR ART

Splitting of stone, either in quarrying or on a smaller scale, such as by a sculptor, is well known. The breaking down of rocks is also a common problem in civil engineering, for example in the forming of roads where large amounts of rock may be excavated and where certain of the rock fragments produced, for example by explosives, need to be broken down further before they can be moved by truck.

Where the stones are relatively large it may be desirable to use an explosive charge to split the rock. Such a procedure involves the risk always present in the use of explosives.

There have been a number of proposals for the simple splitting of rock and the prior art includes U.S. Pat. Nos. 1,719,257 to Booth; 3,963,275 to Godfrey and 4,131,238 to Tarpley.

Of this prior art, Booth discloses a process of splitting rock in which holes are drilled and heat is applied to the rock through the drilled holes. Godfrey teaches a method of breaking free standing rock by firing blunt nose projectiles using a gun. Tarpley is a disclosure of an ultrasonic grinding device using a rotatable drum rollers, vibrated at a resonant frequency to grind rocks between them.

Of the above Booth is believed to be the most pertinent but is still considered somewhat deficient. It may well be of value in splitting a particular stone, and Booth refers specifically to granite, but the present application seeks to provide an apparatus to split a body, especially of stone, and is of wider application.

SUMMARY OF THE INVENTION

Accordingly, the present invention provides apparatus to split a body in which the apparatus is received, the apparatus comprising a first metal component of a first coefficient of expansion; a second metal component of a second coefficient of expansion, different from the first, the second component being attached to the first; whereby heating the apparatus causes a marked distortion in the apparatus to exert force on a body in which it is received, sufficient to split the body.

In the prefered embodiment the apparatus comprises two hemicylinders, joined along their flat faces, for example by silver soldering. Any combination of metals is appropriate provided by a large enough distortion is provided. Examples of metals with quite widely differing thermal coefficients of expansion include iron and copper.

In a further aspect the invention is a method of splitting a body that comprises forming a cavity in the body; locating in the cavity an apparatus that is a close fit within the cavity and comprising a first metal component of a first coefficient of expansion and a second metal component of a second coefficient of expansion, the second component being attached to the first; applying heat to the apparatus whereby the apparatus distorts and exerts a force on the body sufficient to split the body.

BRIEF DESCRIPTION OF THE DRAWINGS

Aspects of the invention are illustrated, merely by way of example, in the accompanying drawings in which.

DESCRIPTION OF PREFERRED EMBODIMENTS

Figure 1:
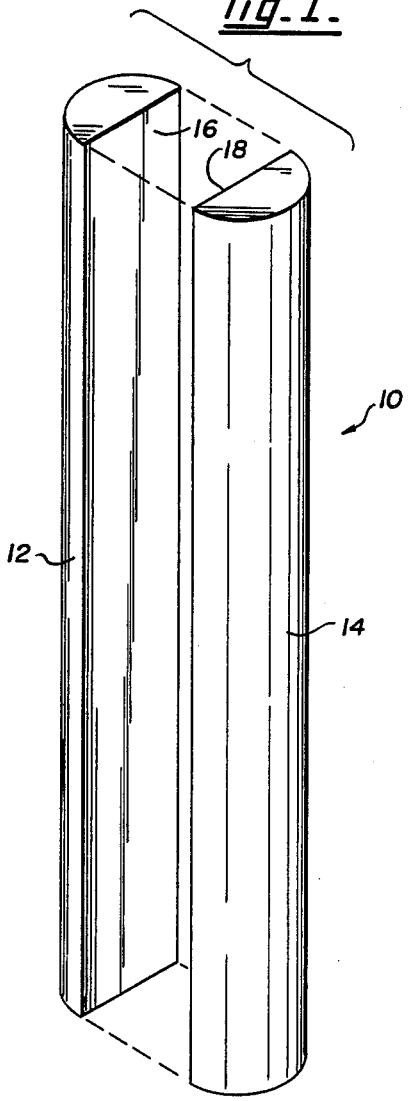
FIG. 1 is an exploded view of one embodiment of the present invention.

The drawings show an apparatus 10 able to split a body in which the body is received. The apparatus comprises first metal component 12 having a first coefficient of expansion and a second metal 14 component of a second coefficient of expansion attached to the first component 12.

In the illustrated embodiments the two components comprising hemicylinders 12 and 14, joined along their flat faces 16 and 18 by known techniques, for example by silver soldering.

Figure 2:
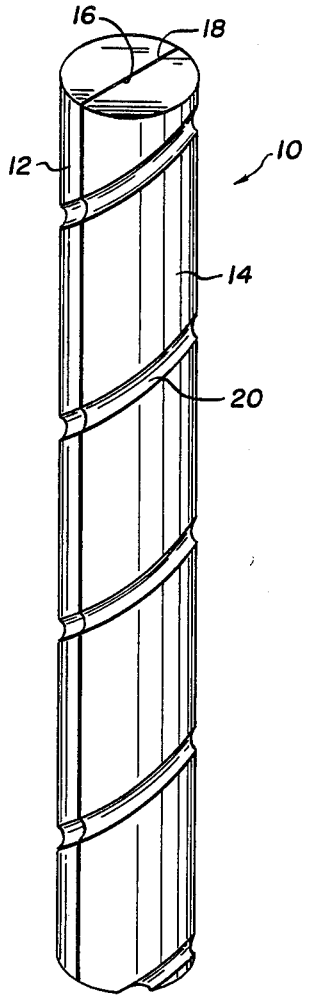
FIG. 2 is an isometric view of the further embodiment.

In the preferred embodiment of FIG. 2 a helical groove 20 extends over the circumference of the apparatus to receive a heating wire. Typically the wire will be one suitable for electrical resistance heating, that is the passage of current through the wire generates a substantial quantity of heat.

The drawings illustrate apparatus 10 of circular cross section simply because this facilitates the location of the apparatus in a body. A cavity can be drilled in the body to receive the apparatus 10.

To use the apparatus in the present invention a cavity is drilled in the body, typically of rock, to be split. The cavity is of a diameter such that the apparatus of FIGS. 1 or 2 is a close slidable fit within the cavity.

Once installed the apparatus 10 is heated and in addition to expansion the body 10 bends due to the different thermal coefficients of expansion of the two components 12 and 14 that make up the body 10. This greatly increases the force that can be inserted by the body on heating.

In the embodiment of FIG. 1 the apparatus may be heated by, for example, directing a stream of burning gas from a blow torch against a portion of the apparatus extending from the cavity. In FIG. 2 an electrical current may be passed through a resistance heating wire located in the helical groove 20. Heat from the wire is passed through the body which then distorts exerting a considerable force sufficient to split a rock.

In practicing the invention it can be desirable to form a plurality of cavities, each to receive an apparatus as shown in FIG. 1 and 2.

The present invention is of application where it is required to split rock. The invention finds application on a small scale, such as might be required by a sculptor, but also finds application in quite large applications, particularly in mining and in civil engineering where quite large rocks may need to be broken.

I claim:

1. Apparatus to split a body in which the apparatus is received, the apparatus comprising:

an iron component of a first coefficient of expansion;

a copper component of a second coefficient of expansion, different from the first, the two components being attached to each other;

whereby heating the apparatus causes a marked distortion in the apparatus to exert force on a body in which it is received, sufficient to split the body.

2. Apparatus as claimed in claim 1 comprising two hemicylinders, joined along their flat faces.

3. Apparatus as claimed in claim 1 including a helical groove extending over the circumference of the apparatus to receive a heating wire.

4. A method of splitting a body that comprises:

forming a cavity in the body;

locating in the cavity an apparatus that is a close fit within the cavity and comprising an iron component of a first coefficient of expansion and a copper component of a second coefficient of expansion, the two components being attached to each other;

applying heat to the apparatus whereby the apparatus distorts and exerts a force on the body sufficient to split the body.

5. A method as claimed in claim 4 including forming a plurality of cavities, each to receive its own splitting apparatus.

6. A method as claimed in claim 4 in which the heat applied is by electrical resistance heating.

* * * * *